US005993180A

United States Patent [19]

Westerhof et al.

[11] Patent Number: 5,993,180

[45] Date of Patent: Nov. 30, 1999

[54] PUMP, PUMP AND HOLDER ASSEMBLY, PERSONAL-CARE APPLIANCE, AND METHOD OF ASSEMBLING A PUMP

[75] Inventors: Willem A. Westerhof, Drachten; Lambertus J. Pezij, ET Paterswolde, both of Netherlands

[73] Assignee: U.S. Philips Corporation, New York, N.Y.

[21] Appl. No.: 09/066,379

[22] PCT Filed: Aug. 15, 1997

[86] PCT No.: PCT/IB97/00993

§ 371 Date: Apr. 29, 1998

§ 102(e) Date: Apr. 29, 1998

[87] PCT Pub. No.: WO98/08661

PCT Pub. Date: Mar. 5, 1998

[30] Foreign Application Priority Data

Aug. 29, 1996 [EP] European Pat. Off. ..... 96202400

[51] Int. Cl.[6] ..... F04B 39/10

[52] U.S. Cl. ..... 417/571

[58] Field of Search ..... 417/571, 472

[56] References Cited

U.S. PATENT DOCUMENTS

| | | | |
|---|---|---|---|
| 4,228,587 | 10/1980 | Bennett | 30/41 |
| 4,417,397 | 11/1983 | Kitamura | 30/34.2 |
| 5,016,351 | 5/1991 | Drahus | 30/41 |
| 5,044,425 | 9/1991 | Tatsumi et al. | 165/240 |
| 5,168,628 | 12/1992 | Mock et al. | 30/41 |
| 5,402,697 | 4/1995 | Brooks | 83/18 |
| 5,564,190 | 10/1996 | Fleetwood | 30/41 |
| 5,673,485 | 10/1997 | Hill | 30/41.5 |

*Primary Examiner*—Mark Paschall
*Assistant Examiner*—Vinod D. Patel
*Attorney, Agent, or Firm*—Ernestine C. Bartlett

[57] ABSTRACT

A pump is assembled, starting from a basic part having an inlet channel and an outlet channel, which terminate in a wall portion, by successively stacking a valve foil provided with an inlet valve and an outlet valve onto the wall portion, stacking an intermediate part having an inlet opening and an outlet opening onto the stack comprising the basic part and the valve foil, stacking an end part of a flexible material onto the stack comprising the basic part, the valve foil and the intermediate part, and securing the end part to the basic part. The pump is particularly suited for use in a personal body care appliance such as an electric shaver, depilating device or body massage device.

15 Claims, 5 Drawing Sheets

PUMP, PUMP AND HOLDER ASSEMBLY, PERSONAL-CARE APPLIANCE, AND METHOD OF ASSEMBLING A PUMP

FIELD OF THE INVENTION

The invention relates to a pump suited for dispensing a fluid in a personal care appliance, comprising a pump chamber bounded by a movable wall, an inlet channel and an outlet channel, which channels are connected to the pump chamber, an inlet valve for closing the inlet channel, and an outlet valve for closing the outlet channel.

The invention further relates to an assembly of a holder for holding a fluid and such a pump.

The invention also relates to an appliance for personal body care including a treatment device for carrying out a body-care treatment under the influence of a fluid, which appliance includes a pump for applying the fluid.

Moreover, the invention relates to a method of assembling such a pump.

BACKGROUND OF THE INVENTION

Such a pump and such an appliance are known from EP-A-0 463 992. The known appliance is a shaver having a holder with a shaving liquid and a pump for pumping the shaving liquid from the holder to a discharge opening of the shaver. The known pump comprises a central tubular element around which a bellows is arranged, an inlet valve being arranged at one end of the tubular element and an outlet valve being arranged at the other end of this element. A drawback of the known pump is that it comprises a comparatively large number of parts. Another drawback is that the dimensions of the pump are large in relation to the corresponding dimensions of the appliance and the holder.

SUMMARY OF THE INVENTION

It is an object of the invention to provide a pump which can be manufactured at very low cost. To this end the pump in accordance with the invention is characterized in that the pump comprises a basic part having a wall portion in which the inlet channel and the outlet channel terminate, the inlet valve and the outlet valve form parts of a valve foil clamped between the wall portion and an intermediate part, the intermediate part has an inlet opening and an outlet opening which correspond to the inlet channel and the outlet channel, and the movable wall belongs to an end part which is supported on the intermediate part.

These measures enable the pump to be built up by stacking a small number of simple parts onto one another. Since the parts are simple they can each be manufactured at low cost. Since the number of parts is small in comparison with the number of parts of the known pump and since the parts can be stacked in a simple manner the total material costs and the assembly costs are substantially lower than in the case of the known pump. Another advantage of the pump in accordance with the invention is that the pump has a substantially smaller overall height than the known pump. As a result of this, the pump in accordance with the invention can be accommodated easily in a personal body care appliance, such as for example a shaver.

An embodiment of the pump in accordance with the invention has the characteristic features that the movable wall comprises a flexible material. As a result, a pump chamber having a variable volume is obtained in a simple manner. Thus, the volume of the pump chamber will decrease in response to a force acting on the movable wall in the direction of the intermediate part and the volume of the pump chamber will increase again under the influence of the flexibility of the end part when this force is reduced.

An embodiment of the pump in accordance with the invention has the characteristic features that the basic part one or more projections for clamping the end part onto the basic part. As a result a stack comprising the basic part, the valve foil, the intermediate part and the end part can be locked up easily. Clamping also results in a proper sealing between the intermediate part and the end part.

An embodiment of the pump in accordance with the invention has the characteristic features wherein the end part has been provided with a rigid mounting ring. A rigid mounting ring makes the end part easier to handle during assembly of the pump and enables the end part to be secured to the basic part in a better and easier manner, for example the mounting ring is snapped in position behind some projections on the basic part. Such an end piece can be manufactured by means of a two-component injection-molding process.

An embodiment of the pump in accordance with the invention has the characteristic features wherein the mounting ring comprises polypropylene (PP) and the flexible material comprises a styrene ethylene butylene styrene (SEBS) elastomer. These measures ensure a proper adhesion between the mounting ring and the flexible portion of the end part. Alternatively, it is possible to use materials which are comparable to PP and SEBS, respectively.

An embodiment of the pump in accordance with the invention has the characteristic features wherein the SEBS elastomer has been reinforced with polyphenyleneoxide (PPO). It has been found that this measure counteracts impairment of the rubber under the influence of the fluid. Instead of PPO it is possible to use a material comparable to PPO.

An embodiment of the pump in accordance with the invention has the characteristic features wherein the value foil comprises PET. By means of this measure it is achieved that the valves function reliably. Instead of PET it is possible to use polypropylene.

The assembly in accordance with the invention comprises a holder for holding a fluid and a pump in accordance with the invention. Such an assembly is suited as a refill for the appliance in accordance with the invention. When such a refill is used the pump is replaced when the holder is empty. This precludes the growth of bacteria in the appliance in accordance with the invention.

The appliance in accordance with the invention is a personal care appliance including a pump in accordance with the invention. Such an appliance should meet stringent requirements as regards hygiene and as regards ease in handling. Hygiene requires that the pump can be replaced at regular intervals, which implies that such a pump should be a low-cost item. For the ease of handling of such an appliance the dimensions of the pump should be small. The pump in accordance with the invention meets both requirements, as a result of which the attractiveness of the appliance increases considerably.

In one embodiment of the appliance in accordance with the invention, the treatment device is adapted to shave off hairs. The invention is particularly advantageous in such an appliance because such an appliance should be easy to handle.

In another embodiment of the appliance in accordance with the invention, is the treatment device comprises a stationary cutter. Such a shaver is intended for use in combination with a fluid, for which the appliance should be moved over the skin in strokes. In accordance with the invention it is achieved that the appliance is light in weight and convenient to manipulate so that the appliance can be moved smoothly over the skin.

In another embodiment of the appliance in accordance with the invention, characterized in that the treatment device comprises a movable shaving member and a drive mechanism for driving the shaving member. As a result, in accordance with the invention it is possible to accommodate a holder with a fluid in the appliance as well as to accommodate the drive mechanism in the appliance without the ease of handling of the appliance being impaired.

Alternatively in an embodiment of the appliance in accordance with the invention, the treatment device is adapted to depilate. In accordance with the invention it is readily possible to accommodate a holder with a fluid in the appliance as well as to accommodate a treatment device for depilation in the appliance without the ease of handling of the appliance being impaired.

The appliance in accordance with the invention, may also be a treatment device adapted to massage a human body. In accordance with the invention it is readily possible to accommodate a holder with a fluid in the appliance as well as to accommodate a treatment device for body massage in the appliance without the ease of handling of the appliance being impaired.

The method in accordance with the invention comprises, starting from a basic part having an inlet channel and an outlet channel, which terminate in a wall portion of the basic part, the stacking of a valve foil onto the wall portion, the stacking of an intermediate part having an inlet opening and an outlet opening onto the stack comprising the basic part and the valve foil, the stacking of an end part of a flexible material onto the stack comprising the basic part, the valve foil and the intermediate part, and the securing of the end part to the basic part.

Because of these measures the pump in accordance with the invention can be assembled in a simple manner. The parts can each be placed onto the stack in the same direction and it suffices to secure the end part to the basic part because the other parts can be retained between the basic part and the end piece.

BRIEF DESCRIPTION OF THE DRAWINGS

The invention will now be described in more detail, by way of example, with reference to the drawings, in which.

DETAILED DESCRIPTION OF THE PREFERRED EMBODIMENTS

Figure 1:
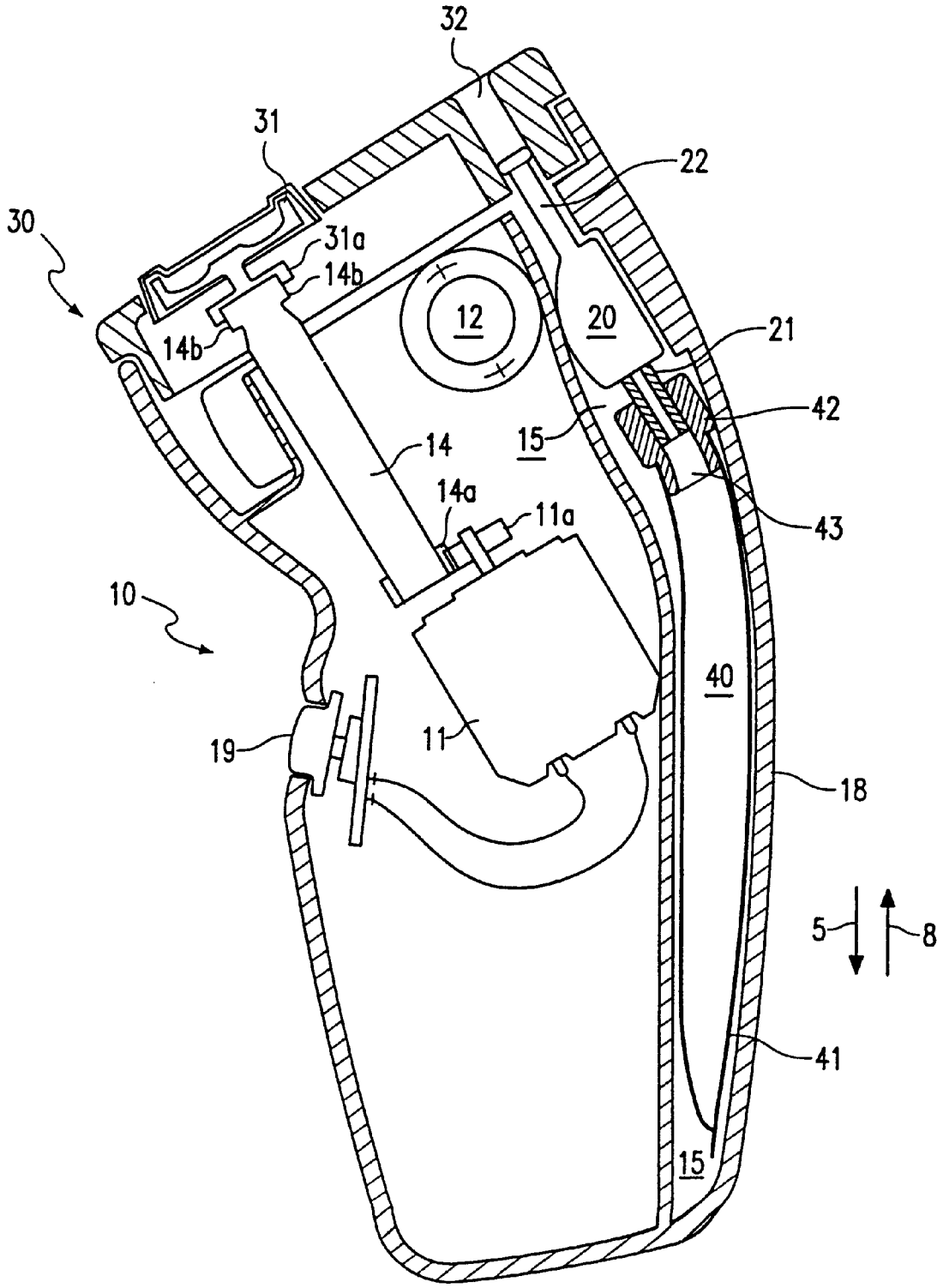
FIG. 1 is a sectional view of a first embodiment of the appliance in accordance with the invention.

FIG. 1 shows a first embodiment of the appliance in accordance with the invention. The appliance, in the present case a shaver 10, comprises a treatment device for carrying out a body-care treatment, in the present case shaving, under the influence of a fluid.

The treatment device comprises an electric motor 11, which can be switched on by means of a push-button 19 on the outside of the appliance 10. The electric motor 11 carries a pinion 11*a*, which is in mesh with a part 31*a* of a movable shaving member in the form of a rotatable cutter 31 via a part 14*b*. When the motor 11 is energized the cutter 31 is driven and it is possible, for example, to remove facial hairs. The cutter 31 is adapted for shaving in conjunction with a fluid. The cutter 31 forms part of a shaving head 30 which is moved over the skin of the user during shaving. The fluid serves to reduce the friction between the shaving head 30 and the skin of the user.

The shaver 10 has a space 15 for accommodating a holder 40 holding the fluid and for accommodating a pump 20. The pump 20 serves for pumping the fluid from the holder 40 to an outlet opening 32 of the appliance 10. The appliance 10 has a push-button 12 by means of which the pump 20 can be driven via a drive mechanism, not shown.

Figure 2:
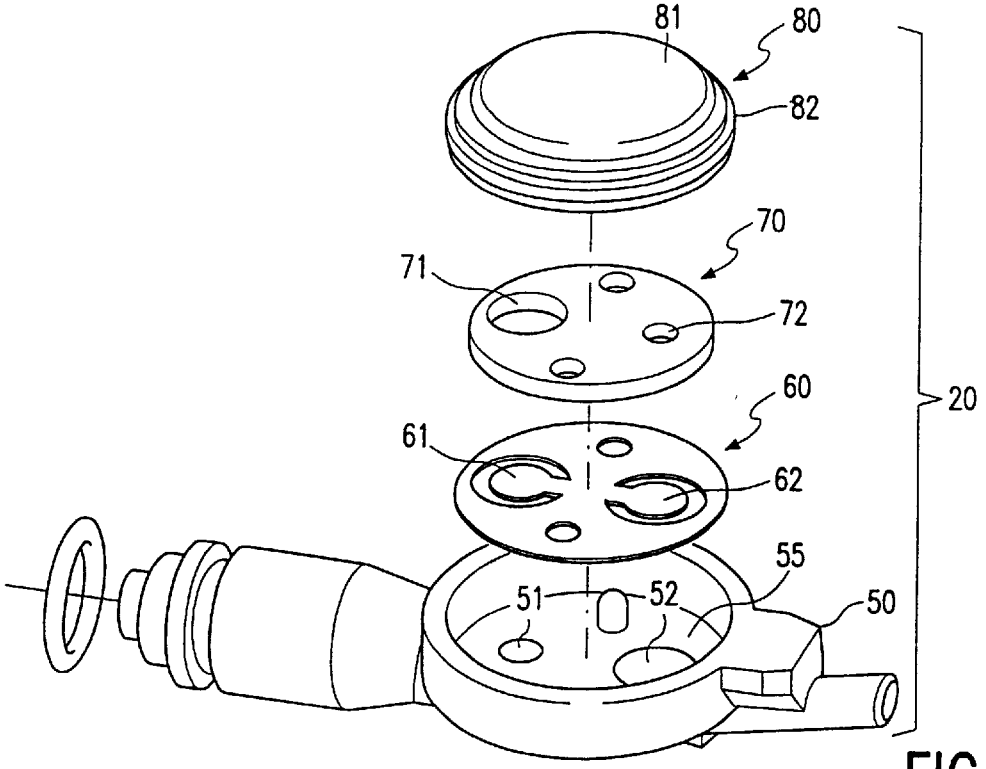
FIG. 2 is an exploded view of a first embodiment of the pump in accordance with the invention.

FIG. 2 is an exploded view of a first embodiment of the pump in accordance with the invention. The pump 20 can be assembled, starting from a basic part 50 having an inlet channel 51 and an outlet channel 52, which terminate in a wall portion 55, by successively stacking a valve foil 60 provided with an inlet valve 61 and an outlet valve 62 onto the wall portion 55, stacking an intermediate part 70 having an inlet opening 71 and an outlet opening 72 onto the stack comprising the basic part 50 and the valve foil 60, stacking an end part 80 of a flexible material onto the stack comprising the basic part 50, the valve foil 60 and the intermediate part 70, and securing the end part 80 to the basic part 50.

Figure 3:
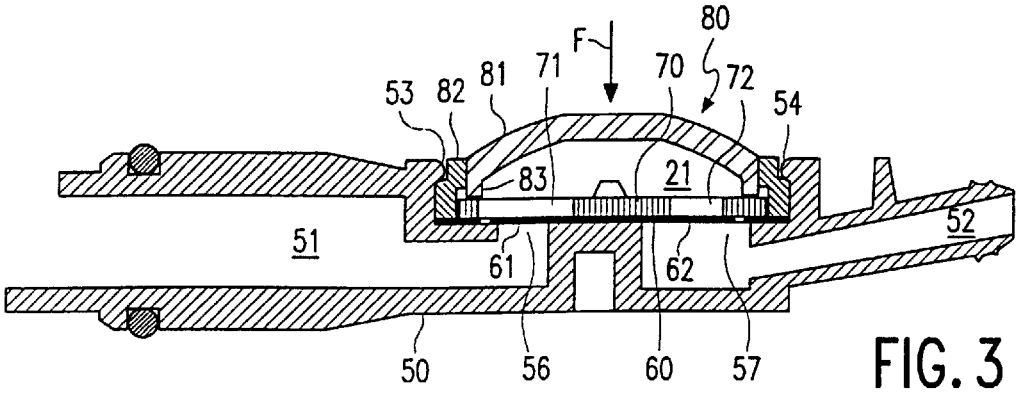
FIG. 3 is a sectional view of the pump shown in FIG. 2.

FIG. 3 is a sectional view of the pump shown in FIG. 2. The pump 20 has a pump chamber 21 bounded by a movable wall 81 which belongs to the end part 80. The end part 80 has been clamped onto the basic part 50 via latching projections 53 and 54. The inlet channel 51 and the outlet channel 52 have been formed in the basic part 50 and are coupled to the pump chamber 21 via the inlet valve 61 to close the inlet channel 51 and via the outlet valve 62 to close the outlet channel 52. The inlet valve 61 and the outlet valve 62 form parts of the valve foil 60, which is clamped between the basic part 50 and the intermediate part 70. The intermediate part 70 has an inlet opening 71 and an outlet opening 72, which correspond to the inlet channel 51 and the outlet channel 52. The movable wall 81 is made of a flexible SEBS rubber reinforced with PPO. The wall 81 is connected to a rigid mounting ring 82 made of polypropylene. The mounting ring 82 snaps behind the projections 53 and 54 and the rim 83 is pressed onto the intermediate part 70 and provides a sealing between the end part 80 and the intermediate part 70 owing to a given oversize of the rim 83. Thus, the intermediate part 70, the valve foil 60 and the basic part 50 are clamped onto one another and a satisfactory sealing is obtained between these parts.

The pump operates as follows. When a force F is exerted on the wall 81, this wall 81 is deformed and the volume of the pump chamber decreases. As a result of this, the pressure in the pump chamber increases and, since the transverse dimensions of the opening 57 are greater than the corresponding dimensions of the outlet valve 62. the outlet valve 62 will be deflected downward and a part of the fluid present in the pump chamber 21 will be displaced to the outlet channel 52. The inlet valve 61 then bears against the basic part 50 because the opening 56 has transverse dimensions which are smaller than the corresponding dimensions of the inlet valve 61. When the force F is reduced the wall 81 will spring back, as a result of which the volume of the pump chamber 21 increases and the pressure in the pump chamber 21 decreases. Consequently, the outlet valve 62 will spring back and will be pressed against the intermediate part 70, because the transverse dimensions of the opening 72 are smaller than the corresponding dimensions of the outlet valve 62. In addition, the inlet valve 61 will be deflected upward because the transverse dimensions of the opening 71 are greater than the corresponding dimensions of the inlet valve 61 and a part of the fluid present in the inlet channel 51 will be displaced to the pump chamber 21. The valve foil is made of PET in order ensure that the valves spring back correctly and can handle a substantial pressure difference.

Figure 4:
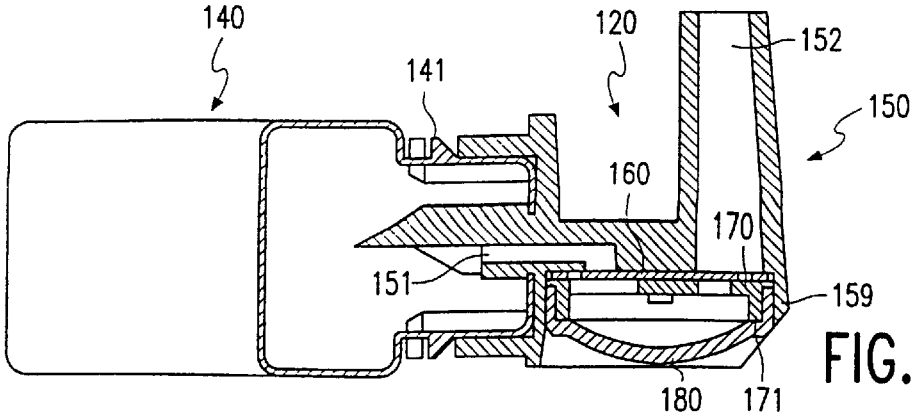
FIG. 4 is a sectional view of an assembly of a holder and a pump in accordance with a second embodiment of the invention.

FIG. 4 is a sectional view of an assembly of a holder and a pump in accordance with a second embodiment of the invention. The pump 120 comprises a basic part 150 having an inlet channel 151 and an outlet channel 152. The pump 120 further comprises a valve foil 160, an intermediate part 170 and a diaphragm 180. The diaphragm 180 consists of an elastomer and is clamped between a raised edge 171 of the intermediate part 170 and a raised edge 159 of the basic part 150. The holder 140 is coupled to the pump 120 via the inlet channel 151.

Figure 5:
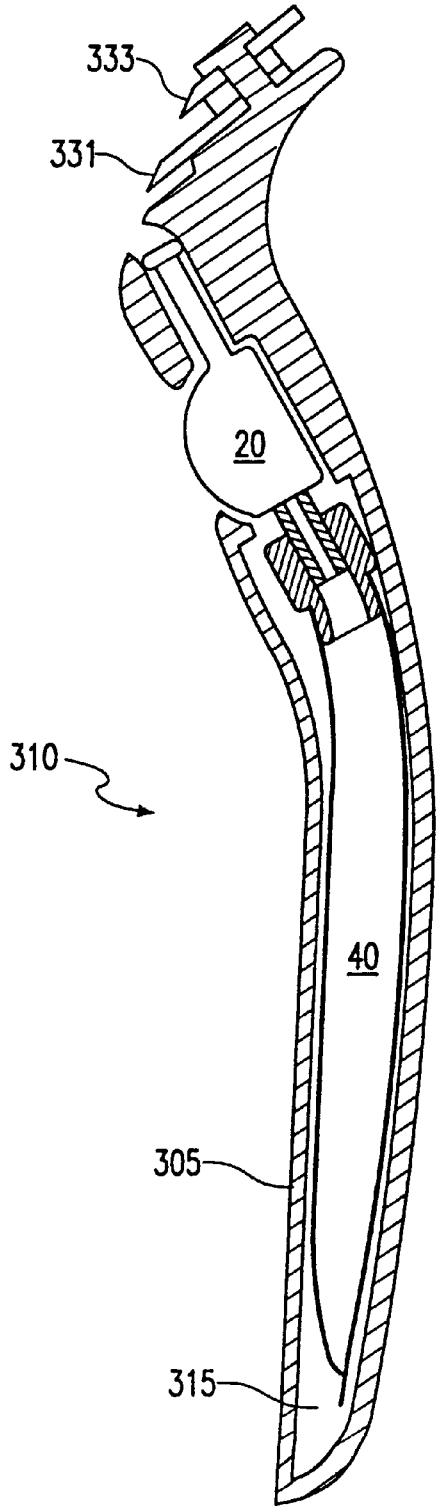
FIG. 5 shows a second embodiment of the appliance in accordance with the invention.

FIG. 5 shows a second embodiment of the appliance in accordance with the invention. It is a shaver 310 comprising a handle 305 and two stationary cutters 331 and 333 for shaving off hairs. The handle 305 has a space 315 which accommodates a holder 40 and a pump 20 as described hereinbefore.

Figure 6:
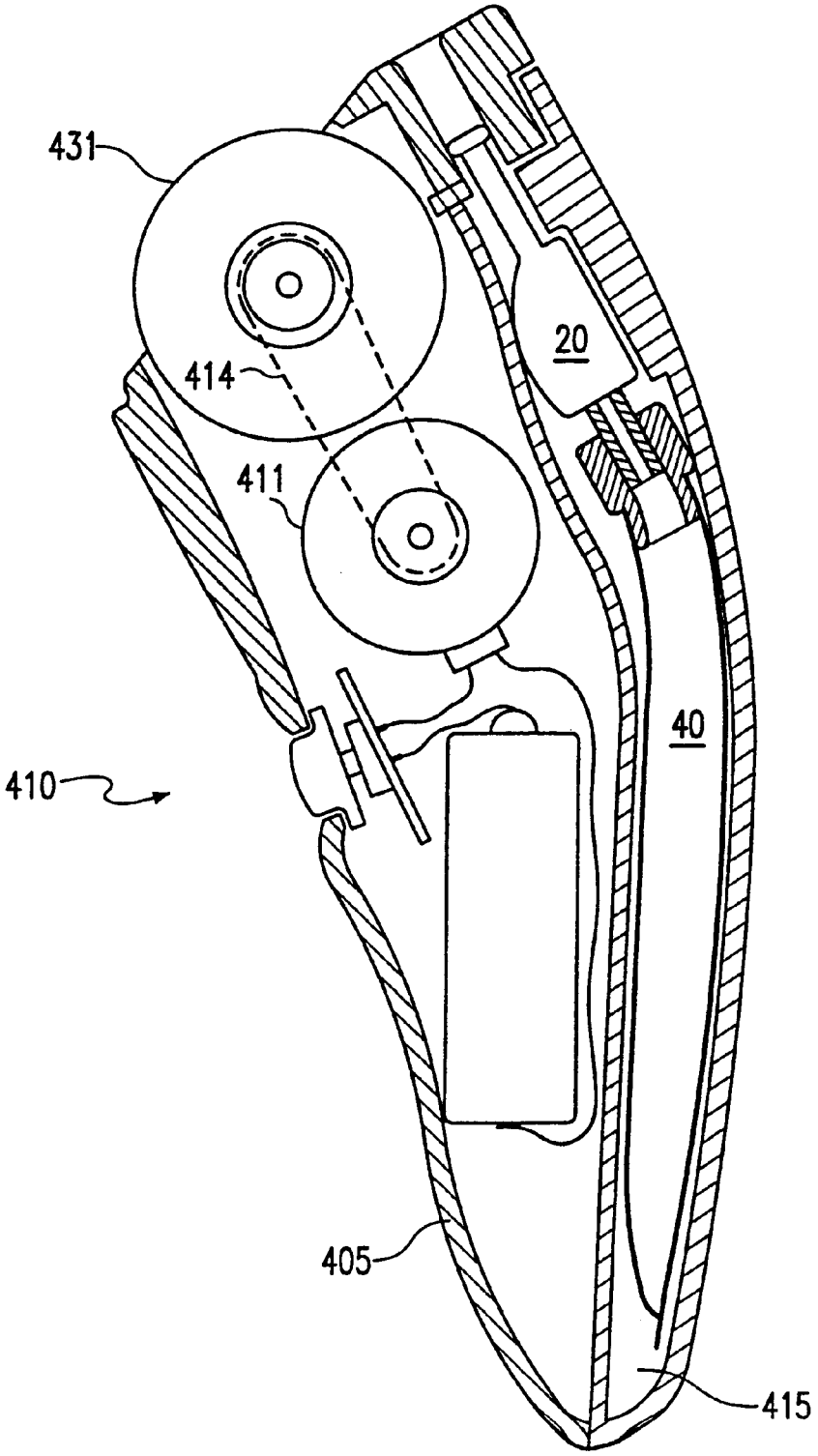
FIG. 6 shows a third embodiment of the appliance in accordance with the invention.

FIG. 6 shows a third embodiment of the appliance in accordance with the invention. The appliance is a depilation appliance 410 comprising a housing 405, an electric motor 411, a drive belt 414 and a set of depilation discs for the extraction of hairs. The housing 404 has a space 415 which accommodates a holder 40 and a pump 20 as described hereinbefore.

Figure 7:
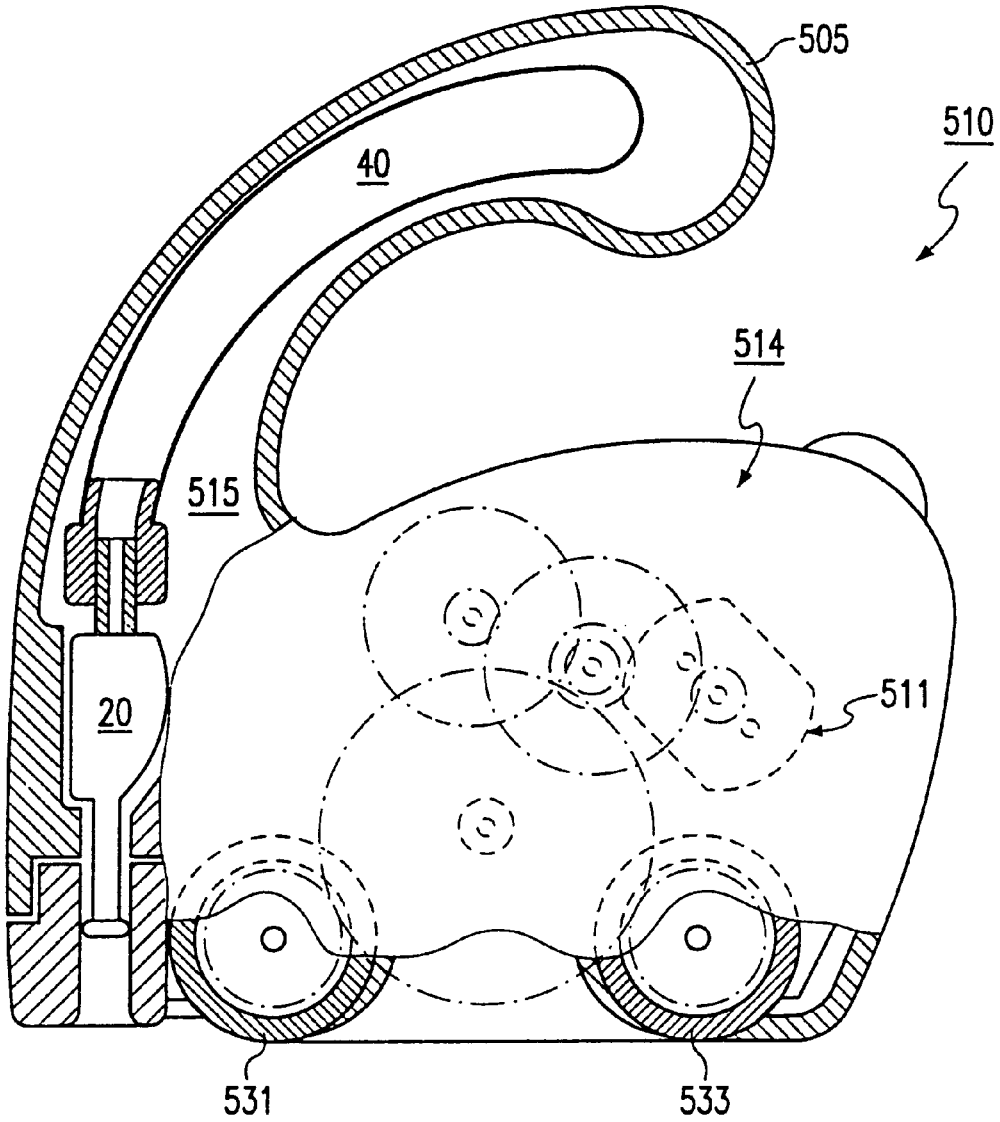
FIG. 7 shows a fourth embodiment of the appliance in accordance with the invention.

FIG. 7 shows a fourth embodiment of the appliance in accordance with the invention. The appliance is a massaging appliance 510 comprising a housing 505, an electric motor 511, a transmission mechanism 514 and two massaging rollers 531 and 533 for massaging the skin of the user. The housing 505 has a space 515 which accommodates a holder 40 and a pump 20 as described hereinbefore.

It is to be noted that the invention is not limited to the embodiments shown herein. Various other embodiments are possible within the scope of the invention. It is, for example, possible to glue or weld the parts of the pump to one another. Besides, the appliance can be another appliance for personal body care which carries out a body-care treatment under the influence of a fluid. In such appliances it is always a great advantage if the pump can be manufactured at low cost and can be comparatively small so that the provision of a space for accommodating the holder does not affect or hardly affects the ergonomics of the appliance.

We claim:

1. A pump (20; 120) suitable for dispensing a fluid in a personal care appliance, comprising a pump chamber (21) bounded by a movable wall (81), an inlet channel (51) and an outlet channel (52), which channels are connected to the pump chamber, an inlet valve (61) for closing the inlet channel, and an outlet valve (62) for closing the outlet channel, characterized in that the pump comprises a basic part (50) having a wall portion (55) in which the inlet channel (51) and the outlet channel (52) terminate, the inlet valve (61) and the outlet valve (62) form parts of a valve foil (60) clamped between the wall portion and an intermediate part (70), the intermediate part (70) has an inlet opening (71) and an outlet opening (72) which correspond to the inlet channel (51) and the outlet channel (52), and the movable wall (81) belongs to an end part (80) which is supported on the intermediate part (70).

2. A pump as claimed in claim 1, characterized in that the movable wall (81) comprises a flexible material.

3. A pump as claimed in claim 1, characterized in that the basic part (50) has one or more projections (53, 54) for clamping the end part (80) onto the basic part.

4. A pump as claimed in claim 1, characterized in that the end part (80) has been provided with a rigid mounting ring (82).

5. A pump as claimed in claim 2, characterized in that the mounting ring (82) comprises polyprylene (PP) and the flexible material comprises a styrene ethylen butylene styrene (SEBS) elastomer.

6. A pump as claimed in claim 5, characterized in that the SEBS elastomer has been reinforced with poly-phenylene oxide (PPO).

7. A pump as claimed in claim 1, characterized in that the valve foil (60) comprises PET.

8. An assembly of a holder (40; 140) for holding a fluid and a pump (20; 120) as claimed in claim 1.

9. An appliance (10; 310; 410; 510) for personal body care, comprising a treatment device (11, 14, 31; 331, 333; 411, 414, 431; 511, 514, 531, 533) for carrying out a body-care treatment under the influence of a fluid, which appliance comprises a pump as claimed in claim 1 for applying the fluid.

10. An appliance (10; 310; 410; 510) as claimed in claim 9, characterized in that the treatment device (11, 14, 31; 331, 333) is adapted to shave off hairs.

11. An appliance (310) as claimed in claim 10, characterized in that the treatment device comprises a stationary cutter (331, 333).

12. An appliance (10) as claimed in claim 10, characterized in that the treatment device comprises a movable shaving member (31) and a drive mechanism (11, 14) for driving the shaving member.

13. An appliance (410) as claimed in claim 9, characterized in that the treatment device (411, 414, 431) is adapted to depilate.

14. An appliance (510) as claimed in claim 4, characterized in that the treatment device (511, 514, 531, 533) is adapted to massage a human body.

15. A method of assembling a pump (20; 120), starting from a basic part (50) having an inlet channel (51) and an outlet channel (52), which terminate in a wall portion (55) of the basic part, which method comprises the stacking of a valve foil (60) onto the wall portion, the stacking of an intermediate part (70) having an inlet opening (71) and an outlet opening (72) onto the stack comprising the basic part (50) and the valve foil (60), the stacking of an end part (80) of a flexible material onto the stack comprising the basic part, the valve foil and the intermediate part, and the securing of the end part (80) to the basic part (50).

* * * * *